US010040664B2

(12) United States Patent
Kangas

(10) Patent No.: US 10,040,664 B2
(45) Date of Patent: Aug. 7, 2018

(54) POSITIONING APPARATUS, ELEVATOR AND A METHOD FOR DETERMINING THE POSITION OF AN ELEVATOR CAR BY USING CLASSIFIED POSITION IDENTIFIERS

(71) Applicant: KONE Corporation, Helsinki (FI)

(72) Inventor: Petteri Kangas, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 412 days.

(21) Appl. No.: 14/816,890

(22) Filed: Aug. 3, 2015

(65) Prior Publication Data

US 2016/0039635 A1 Feb. 11, 2016

(30) Foreign Application Priority Data

Aug. 11, 2014 (FI) ..... 20145709

(51) Int. Cl.

| | |
|---|---|
| ***B66B 1/34*** | (2006.01) |
| ***B66B 3/02*** | (2006.01) |
| ***B66B 5/02*** | (2006.01) |
| ***B66B 1/48*** | (2006.01) |
| ***B66B 1/50*** | (2006.01) |

(52) U.S. Cl.

CPC ..... *B66B 1/3492* (2013.01); *B66B 1/48* (2013.01); *B66B 1/50* (2013.01); *B66B 3/02* (2013.01); *B66B 5/02* (2013.01)

(58) Field of Classification Search

CPC ..... B66B 1/3492; B66B 1/48; B66B 1/50; B66B 3/02; B66B 5/02

USPC ..... 187/247, 277, 391, 393, 394

See application file for complete search history.

(56) References Cited

U.S. PATENT DOCUMENTS

| | | | | |
|---|---|---|---|---|
| 3,048,818 | A * | 8/1962 | Burckhardt | B66B 1/50 187/394 |
| 5,509,505 | A * | 4/1996 | Steger | B66B 1/40 187/393 |
| 5,682,024 | A * | 10/1997 | Koopman, Jr. | B66B 1/50 187/283 |

(Continued)

FOREIGN PATENT DOCUMENTS

| | | |
|---|---|---|
| DE | 100 23 503 A1 | 11/2001 |
| EP | 0 661 228 A2 | 7/1995 |

(Continued)

*Primary Examiner* — Anthony Salata

(74) *Attorney, Agent, or Firm* — Birch, Stewart, Kolasch & Birch, LLP

(57) ABSTRACT

A positioning apparatus for an elevator car, an elevator and also a method for determining the position of an elevator car are disclosed. The positioning apparatus for an elevator car includes a plurality of position identifiers possessing a readable physical property, which position identifiers are disposed by the side of the trajectory of the elevator car and also a reader device installed on the elevator car for reading a physical property of the position identifiers. The aforementioned readable physical property of a position identifier is adapted to classify each position identifier according to the intended use of the position identifier into one of two or more optional classes, and in the position identifiers belonging to at least one aforementioned class the same physical property is additionally adapted to indicate the linear position of the elevator car.

20 Claims, 3 Drawing Sheets

(56) References Cited

U.S. PATENT DOCUMENTS

| | | | | |
|---|---|---|---|---|
| 5,783,783 | A * | 7/1998 | Toutaoui | B66B 1/3492 187/294 |
| 5,831,227 | A * | 11/1998 | Finn | B66B 1/50 187/291 |
| 5,889,239 | A | 3/1999 | Blackaby et al. | |
| 7,325,657 | B2 * | 2/2008 | Angst | B66B 5/0018 187/247 |
| 7,350,624 | B2 * | 4/2008 | Deplazes | B66B 13/22 187/316 |
| 7,533,763 | B2 * | 5/2009 | Kattainen | B66B 1/28 187/287 |
| 7,669,698 | B2 * | 3/2010 | Jahkonen | B66B 1/3492 187/247 |
| 7,849,975 | B2 * | 12/2010 | Ketonen | B66B 13/22 187/316 |
| 7,891,467 | B2 * | 2/2011 | Kattainen | B66B 5/0056 187/316 |
| 8,408,364 | B2 * | 4/2013 | Kangas | B66B 1/3492 187/247 |
| 9,567,188 | B2 * | 2/2017 | Huff | B66B 1/3492 |
| 2012/0031710 | A1 | 2/2012 | Meri et al. | |
| 2015/0314985 | A1 * | 11/2015 | Schoenauer | B66B 1/3492 187/394 |

FOREIGN PATENT DOCUMENTS

| | | | |
|---|---|---|---|
| JP | 2002-167133 | A | 6/2002 |
| WO | WO 2013-118317 | A1 | 8/2013 |
| WO | WO 2014/082258 | A1 | 6/2014 |

* cited by examiner 1A,1B,1C,1D,1E: permanently-magnetized position identifiers
2: reader device
3: elevator car
4: elevator hoistway
7: electric drive
7A: frequency converter
7B: hoisting machine
8: electricity distribution network
9: elevator control unit
12: stopping floor
x: trajectory
s: linear position 1E,1F: permanently-magnetized position identifiers
5A: permanent magnets
x: trajectory

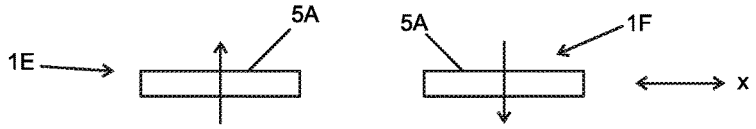

Fig. 2a

1D: permanently-magnetized position identifier
5A,5B: permanent magnets
5: sinusoidal magnetic field
x: trajectory
L:wavelength

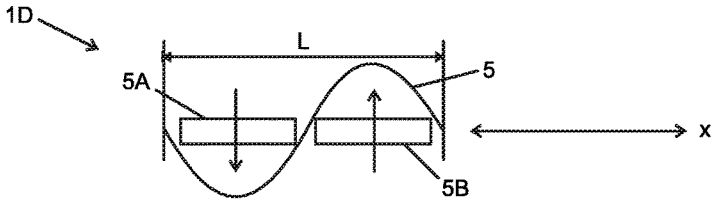

Fig. 2b 1A,1B: permanently-magnetized position identifiers
5A,5B,5C,5D: permanent magnets
5: sinusoidal magnetic field
x: trajectory
L:wavelength

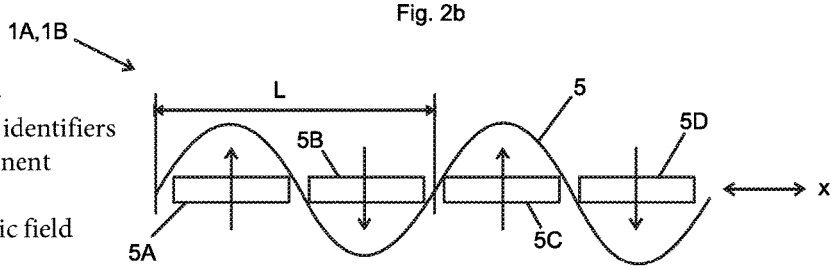

Fig. 2c 1A,1B: permanently-magnetized position identifiers
5A,5B,5C,5D: permanent magnets
14: center point
x: trajectory

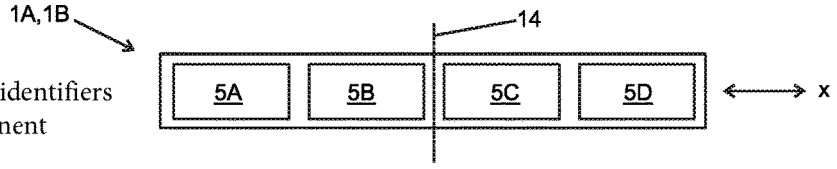

Fig. 2d 2A,2B,2C,2D,2E,2F: sensors
2: reader device
15: center point
L:wavelength
x: trajectory

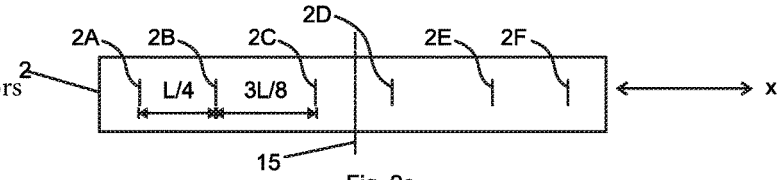

Fig. 2e

13: signal
x: trajectory

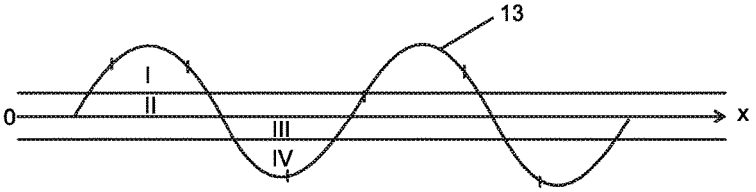

Fig. 2f 1A,1B,1C,1E: permanently-magnetized position identifiers
5: sinusoidal magnetic field
x: trajectory 1A,1B,1G,1F: permanently-magnetized position identifiers
5: sinusoidal magnetic field
x: trajectory

POSITIONING APPARATUS, ELEVATOR AND A METHOD FOR DETERMINING THE POSITION OF AN ELEVATOR CAR BY USING CLASSIFIED POSITION IDENTIFIERS

FIELD OF THE INVENTION

The invention relates to solutions for determining the position of an elevator car.

BACKGROUND OF THE INVENTION

The position of an elevator car in the elevator hoistway can be measured indirectly from the rotational movement of the hoisting machine of the elevator. In this case a measuring error can arise, e.g. from elongation of the elevator ropes or from slipping of the elevator ropes on the traction sheave of the hoisting machine.

The location of an elevator car on a stopping floor can be detected with a magnetic switch fastened to the elevator car, which switch reacts to a permanent magnet disposed in the elevator hoistway in the proximity of the stopping floor. The mechanical contacts of magnetic switches are unreliable; vibration or an impact may cause failure of the contact, and mechanical contacts also oxidize easily.

Separate sensors, such as switches or ramps, are also usually disposed in the elevator hoistway, with which sensors the extreme limits of permitted movement of the elevator car in the elevator hoistway are measured.

Taking what is described above into account, there is a need to develop positioning solutions for an elevator car that are simpler and more reliable than those known in the art.

SUMMARY OF THE INVENTION

The aim of the invention is to disclose a positioning solution for an elevator car, the solution being simpler and more reliable than those known in the art.

The preferred embodiments of the invention are presented in the dependent claims. Some inventive embodiments and also inventive combinations of the various embodiments are also presented in the descriptive section and in the drawings of the present application.

One aspect of the invention is a positioning apparatus for an elevator car, comprising a plurality of position identifiers possessing a readable physical property, which position identifiers are disposed by the side of the trajectory of the elevator car as well as a reader device installed on the elevator car for reading a physical property of the position identifiers. The aforementioned readable physical property of the position identifier is adapted to classify each aforementioned position identifier according to the intended use of the position identifier into one of two or more optional classes, and in the position identifiers belonging to at least one aforementioned class the same physical property is additionally adapted to indicate the linear position of the elevator car.

A second aspect of the invention is an elevator, comprising an elevator car, which is adapted to be movable along a trajectory determined by guide rails, as well as an electric drive for driving the elevator car. The elevator also comprises a positioning apparatus according to the description for determining the location of the elevator car.

A third aspect of the invention is a method for determining the position of an elevator car with the positioning apparatus according to the description. In the method a physical property of a position identifier is read with the reader device and also the position identifier is classified, on the basis of the physical property read, according to the intended use of the position identifier.

This means that the position identifiers are classified according to their intended use to indicate the task of the position identifier and thereby also the location of the elevator car in the elevator hoistway. In addition, position identifiers belonging to one or more certain classes indicate the linear position of the position identifier/elevator car in the elevator hoistway; for example, the position identifiers indicating the location of a stopping floor of the elevator car also contain the exact linear position of the elevator car in the proximity of the stopping floor. The same readable physical property of the position identifier indicates both the purpose/class of the position identifier as well as the linear position, in which case they can be measured with the same sensor, which simplifies the positioning apparatus. When the number of components decreases, the reliability of the positioning apparatus also improves.

In the description the term "linear position of the elevator car" means the position data of the elevator car indicated by the position identifier, said position data changing linearly and essentially steplessly in the measuring range determined by the readable physical property of the position identifier. A readable physical property of a position identifier can be e.g. a magnetic field, inductance, capacitance, refractive index, the permeability of an optical signal or an optical signal transmitted by a position identifier, resistance, an ultrasound signal transmitted by a position identifier, an electromagnetic signal or corresponding, that is read with a reader device configured for this purpose.

In some embodiments the readable physical property of a position identifier is adapted to vary at different points of the position identifier. According to one or more embodiments of the invention the readable physical property varies in the position identifier in the direction of the trajectory of the elevator car.

According to one or more embodiments of the invention the reader device comprises a plurality of sensors that are disposed consecutively and are configured to read the aforementioned readable physical property for determining the class of the position identifier as well as the linear position of the elevator car.

According to one or more embodiments of the invention the reader device comprises a processor, which is connected to the aforementioned sensors that are configured to read a readable physical property. The reader device comprises a memory, in which a program to be executed by the processor has been recorded, wherein the processor is configured to read the measuring data of the sensors to classify a position identifier on the basis of the measuring data being read from the sensors and, if the class of the position identifier fulfills a preselected criterion, to calculate the linear position of the elevator car on the basis of the measuring data being read from the sensors.

According to one or more embodiments of the invention, the same physical property of a position identifier is adapted to detect, in only some of the classes, also the linear position of the elevator car in the position identifiers belonging to the class(es) in question.

According to one or more embodiments of the invention the aforementioned sensors form sensor pairs, which are disposed consecutively at uniform intervals. Each sensor pair is able to independently read the linear position of the elevator car.

According to one or more embodiments of the invention the reader device is configured to register simultaneously the signals produced by different sensors.

According to one or more embodiments of the invention the class of a position identifier comprises two or more of the following:

top end limit identifier of elevator car trajectory
bottom end limit identifier of elevator car trajectory
stopping floor identifier
bottom floor identifier
top floor identifier
servicing space identifier
identifier of reference point between stopping floors According to one or more embodiments of the invention, if classification of the position identifier does not succeed, the elevator is removed from service. Otherwise the location of the elevator car in the elevator hoistway is determined on the basis of the class of the position identifier.

According to one or more embodiments of the invention, if the class of a position identifier fulfills a preselected criterion, the linear position of the elevator car is calculated on the basis of a readable physical property of the position identifier.

In one preferred embodiment of the invention the aforementioned readable physical property of a position identifier is a magnetic field. The magnetic field is formed to vary in the position identifiers in such a way that the shape of the magnetic field contains information about the class of the position identifier as well as, in some classes, also the linear position of the elevator car. Use of a magnetic field allows for the measuring device a relatively large lack of verticality and/or deviation in the perpendicular direction to the movement direction of the elevator car/measuring device, which improves the fault tolerance of the positioning apparatus. Also the detection of a magnetic field does not require movement of the elevator car, so that the position can be detected also when the elevator car is stationary, e.g. at a stopping floor or at an end limit identifier. In some embodiments the reader device comprises a plurality of magnetic sensors, such as Hall sensors or magnetoresistive sensors, which read the magnetic field of the position identifiers. In some embodiments the reader device is configured to classify each position identifier on the basis of the shape of the magnetic field of the position identifier and also, if the position identifier belongs to a predetermined class/to predetermined classes, to determine the linear position of the elevator car from the shape/variation profile of the magnetic field of the position identifier in question.

In another embodiment of the invention the aforementioned readable physical property of a position identifier is inductance. The inductance is formed to vary in the position identifiers in such a way that the shape/variation profile of the inductance contains information about the class of each position identifier as well as, in some classes, also the linear position of the elevator car. In some embodiments the reader device comprises a plurality of inductive sensors, which read the inductance of the position identifiers. In some embodiments the reader device is configured to classify each position identifier on the basis of the shape/variation profile of the inductance of the position identifier and also, if the position identifier belongs to a predetermined class/to predetermined classes, to determine the linear position of the elevator car from the shape of the inductance of the position identifier in question.

The aforementioned summary, as well as the additional features and advantages of the invention presented below will be better understood by the aid of the following description of some embodiments, which do not limit the scope of application of the invention.

BRIEF EXPLANATION OF THE FIGURES

FIGS. 2*a*, 2*b*, 2*c* present various position identifiers.

FIG. 2*d* presents the position identifier of FIG. 2*c* as viewed from the front.

FIG. 2*e* presents the placement of sensors in a reader device that is intended to read the position identifiers of FIGS. 2*a*-2*d*.

FIG. 2*f* presents the signals of the sensors of FIG. 2*e* when reading one of the position identifiers of FIGS. 2*a*-2*d*.

MORE DETAILED DESCRIPTION OF PREFERRED EMBODIMENTS OF THE INVENTION

In the following description some generally known features of elevators have not been presented for the sake of clarity.

Figure 1:
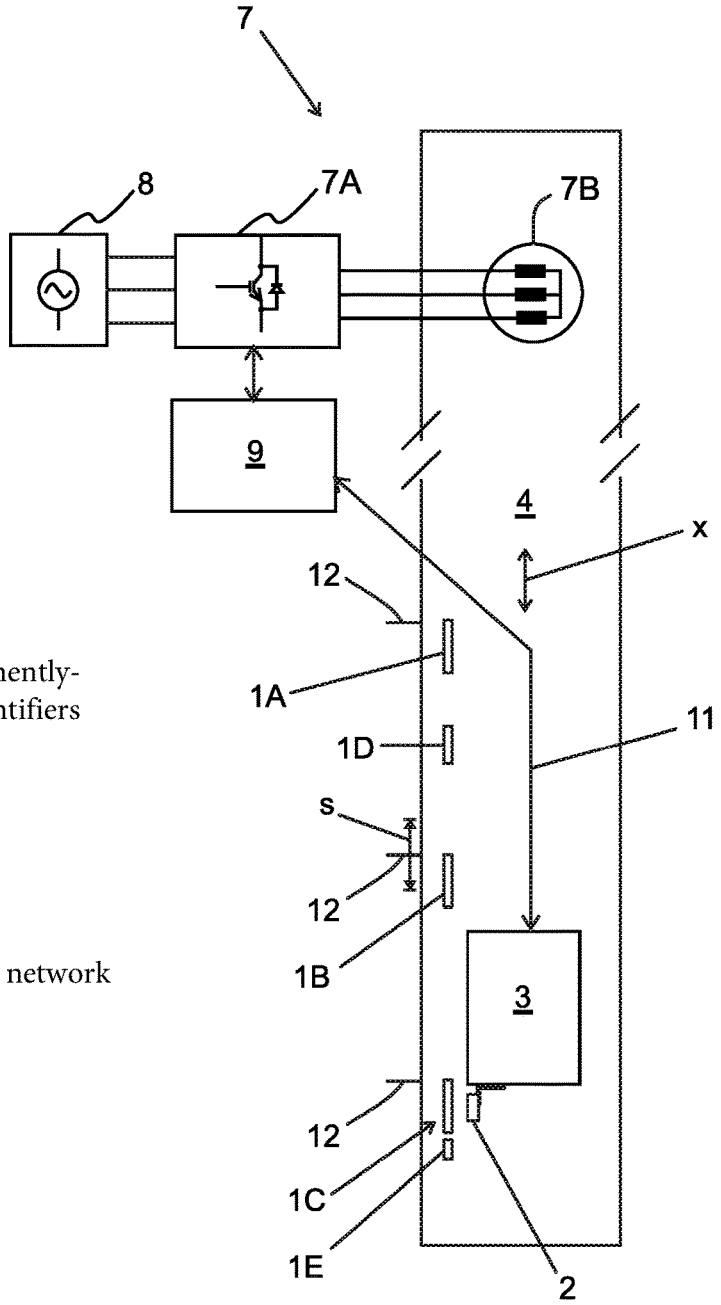
FIG. 1 presents an elevator, in which is installed a positioning apparatus, according to the invention, for an elevator car.

FIG. 1 presents an elevator, which comprises an elevator car 3, which is adapted to be movable in an elevator hoistway 4 along a trajectory x determined by guide rails (not presented in FIG. 1). The elevator also comprises an electric drive 7, for driving the elevator car 3. The electric drive comprises a hoisting machine 7B and also a frequency converter 7A. The elevator car 3 is moved with elevator ropes (not shown in figure) passing via the traction sheave of the hoisting machine 7B. Steel ropes or a special belt, such as a toothed belt, can be used as the hoisting ropes. A belt can have tractive lines, such as steel lines or lines made from synthetic fiber, fitted inside a protective polymer matrix. The elevator car 3 is driven by supplying electric power with the frequency converter 7A from the electricity distribution network 8 to the electric motor of the hoisting machine 7B. The frequency converter 7A is controlled with the movement profile calculated by the elevator control unit 9 in such a way that the elevator car 3 transfers passengers according to the movement profile from one stopping floor 12 to another in the manner required by the elevator calls given by the passengers. The run speed of the elevator car is obtained by measuring the speed of rotation of the traction sheave of the hoisting machine.

A positioning apparatus for determining the location of the elevator car 3 has been fitted to the elevator of FIG. 1. For example, the elevator control unit 9 needs information about the location of the elevator car for calculating the movement profile. Elevator safety, on the other hand, requires that the elevator car 3 remains in the area defined by the extreme limits of permitted movement in the elevator hoistway. These types of extreme limits of permitted movement are e.g. the bottom end limits and the top end limits of the elevator hoistway. There can also be different extreme limits e.g. during normal operation of the elevator and during servicing of the elevator.

The positioning apparatus of FIG. 1 comprises permanently-magnetized position identifiers 1A, 1B, 1C, 1D, 1E, 1F, 1G, which are disposed in the elevator hoistway 4 by the side of the trajectory of the elevator car 3. The position identifiers 1A, 1B, 1C, 1D, 1E, 1F, 1G are read with a reader device 2 installed on the elevator car 3 below the floor. The reader device 2 detects a position identifier 1A, 1B, 1C, 1D, 1E, 1F, 1G when the reader device 2 is situated in the immediate proximity of the position identifier 1A, 1B, 1C, 1D, 1E, 1F, 1G. The position data is transferred from the reader device 2 to the elevator control unit 9 along the trailing cables 11. The reader device 2 can also be situated elsewhere in connection with the elevator car 3, e.g. on the roof of the elevator car 3.

The position identifiers 1A, 1B, 1C, 1D, 1E, 1F, 1G are classified according to their intended use. Position identifiers 1A, 1B, 1C, 1D, 1G belonging to certain classes also indicate the linear position s of the elevator car 3, i.e. the linearly and steplessly varying position data of the elevator car 3 in the measuring range of the position identifier. Exact linear position data s is needed e.g. when stopping the elevator car at a stopping floor 12, so that the floor of the elevator car 3 can be driven precisely to the point of the floor level 12 in such a way that a step detrimental to passage does not form between the floor level 12 and the floor of the elevator car 3. Both the class of the position identifier and also the linear position data are coded into the magnetic field of a position identifier. Consequently, inter alia, stopping floor identifiers as well as the extreme limit identifiers required for elevator safety are made by classifying the position identifiers. At least the following classes of position identifier are possible:

bottom end limit identifier of elevator car trajectory 1E
top end limit identifier of elevator car trajectory 1F
stopping floor identifier 1A, 1B
top floor identifier 1C
bottom floor identifier 1G
servicing space identifier
identifier 1D of reference point between stopping floors.

The identifier 1E of the bottom end limit indicates the extreme limit of permitted movement of the elevator car in the pit of the elevator hoistway during normal operation of the elevator, and it is disposed farther away in the bottom end of the elevator hoistway in connection with the bottom floor identifier 1C. The identifier of the top end limit is not presented in FIG. 1, but it is disposed farther away in the top end of the elevator hoistway in connection with the top floor identifier in a corresponding manner to the bottom end limit identifier. The servicing space identifier is also not presented in FIG. 1; the servicing space identifiers mark the extreme limit of permitted movement of the elevator car during servicing of the elevator. The servicing space identifiers are disposed in connection with the top end and bottom end of the elevator hoistway 4 farther from the ends than the end limit identifiers, so that sufficient safety space and working space for a serviceman remains in the proximity of the ends outside the trajectory of the elevator car 3. The identifier 1D of a reference point between stopping floors 12 is used to increase positioning accuracy between stopping floors. It can also be used e.g. as a mark of the deceleration point of the elevator car to indicate the point at which the elevator car must start to decelerate when stopping at a floor. The identifier 1D can also mark a point that allows a serviceman access from the floor level of a stopping floor 12 to the roof of the elevator car via the hoistway door (i.e. a point where the roof of the car and the floor level are at the same height).

The stopping floor identifiers 1A, 1B are disposed in such a way that the floor of the elevator car 3 comes to the same height as the floor level 12 when the reader device 2 and the stopping floor identifier 1A, 1B are situated facing each other, see FIG. 1.

Both the classification of position identifiers 1A, 1B, 1C, 1D, 1E, 1F, 1G and the linear position s are read from a position identifier using the same sensors of the reader device 2, which simplifies the positioning apparatus.

Hall sensors 2A, 2B, 2C, 2D, 2E, 2F, which are fitted consecutively in the direction of the trajectory x of the elevator car, are used as sensors in the reader device 2. FIG. 2*e* presents the placement of the sensors in the reader device 2. Two consecutive sensors situated close to each other always form a sensor pair 2A, 2B; 2C, 2D; 2E, 2F. The sensor pairs 2A, 2B; 2C, 2D; 2E, 2F are disposed consecutively at uniform intervals from each other. Each sensor pair is able to independently form the linear position data s of the elevator car. The sensor pair to be used at any given moment for calculating the linear position is selected on the basis of the interpositioning of the reader device 2 and the position identifier in such a way that the greatest possible measurement accuracy of the linear position is achieved. The measuring data of the same sensors is used for determining both the linear position and the class of the position identifier. In addition, the measuring data of different sensors/sensor pairs can, depending on the situation, be combined or compared for improving the reliability of measurements and the measuring accuracy.

As stated earlier, the magnetic field of the position identifiers 1A, 1B, 1C, 1D, 1E, 1F, 1G is read with the sensors 2A, 2B, 2C, 2D, 2E, 2F of the reader device 2. FIGS. 2*a*-2*d* present in more detail the magnetization principle of the position identifiers. FIG. 2*e* presents the placement of the sensors 2A, 2B, 2C, 2D, 2E, 2F in the reader device 2, and FIG. 2*f* the measuring signals of these sensors.

The position identifiers in FIGS. 2*a*-2*c* are presented as viewed from the side. In addition, in FIG. 2*d* the position identifier of FIG. 2*c* is described as viewed directly from the front. The position identifiers are magnetized with permanent magnets 5A, 5B, 5C, 5D, the polarity (direction of magnetic axis) of which is marked with an arrow on the magnets in FIGS. 2*a*-2*c*.

The position identifier of FIG. 2*a* comprises only one permanent magnet 5A. The polarity of the permanent magnet can be selected according to FIG. 2*a* in two different ways. The position identifier of FIG. 2*a* does not form a sinusoidal magnetic field, and it is used either below 1E the trajectory of the elevator car or as a top end limit identifier 1F by changing the polarity of the magnet 5A (i.e. by turning the magnet the other way around). A number of end limit identifier magnets possessing the same polarity can also be disposed consecutively in the direction of movement x of the elevator car, in which case the protection area covered by end limit identifier 1E, 1F is lengthened.

The identifier of FIG. 2*b* comprises two consecutive permanent magnets 5A, 5B, which have different polarities. The magnetic field of the identifier varies sinusoidally, forming one complete sine wave. The identifier of FIG. 2*b* is used as the identifier 1D of a reference point between stopping floors 12.

The identifier of FIG. 2*c* comprises four consecutive permanent magnets 5A, 5B, 5C, 5D, adapted in such a way that consecutive permanent magnets always have different polarities to each other. The sinusoidally variable magnetic field of the identifier of FIG. 2*c* forms two complete sine waves. This type of identifier is used as a stopping floor identifier 1A, 1B. The sinusoidal magnetic field 5 in the identifiers of FIGS. 2*b* and 2*c* has the same wavelength L.

The distance between the permanent magnets in the position identifiers of FIGS. 2*b* and 2*c* and the width of the poles is optimized for achieving the most sinusoidal magnetic field possible. The sinusoidal magnetic field 5 of the identifiers of FIGS. 2*b* and 2*c* is used also in the calculation of the linear position of the elevator car.

Figure 3A:
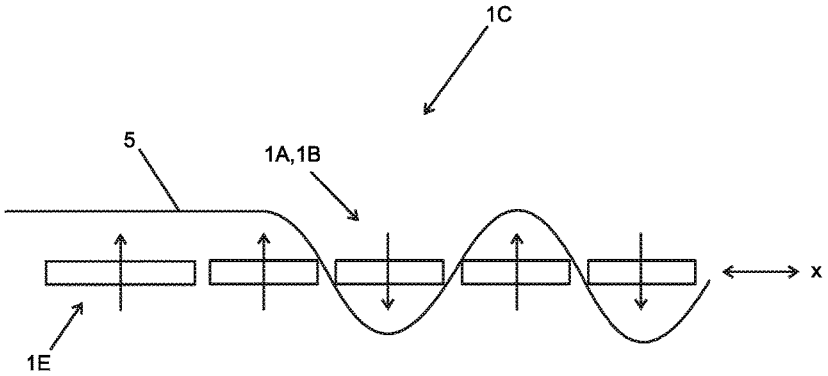
FIG. 3*a* presents a bottom floor identifier according to an embodiment of the invention.
Figure 3B:
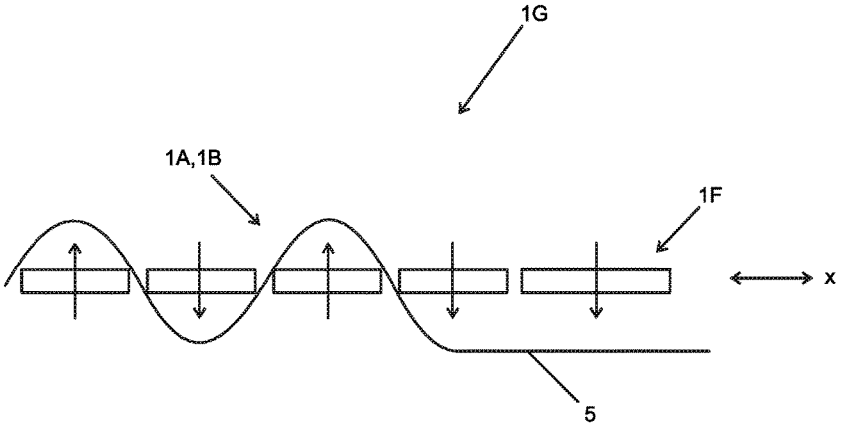
FIG. 3*b* presents a top floor identifier according to an embodiment of the invention.

An end floor identifier is preferably formed by connecting a stopping floor identifier 1A, 1B to an end limit identifier 1E, 1F. Consequently, the bottom floor identifier 1C is formed by connecting the stopping floor identifier 1A, 1B with the bottom end limit identifier 1E (FIG. 3*a*) and the top floor identifier 1G is formed by connecting the stopping floor identifier 1A, 1B with the top end limit identifier 1F (FIG. 3*b*). The magnetic field 5 produced in this manner is sinusoidal elsewhere than within the range of an end limit identifier 1E, 1F. The identification/classification of an end floor identifier 1C, 1G occurs by reading with the reader device 2 the shared resultant of the magnetic fields of a stopping floor identifier 1A, 1B and an end limit identifier 1E, 1F.

In FIG. 2*e* the sensors 2A, 2B, 2C, 2D, 2E, 2F are disposed symmetrically on both sides of the center point 15 of the reader device 2. Two adjacent sensors situated close to each other form a sensor pair 2A, 2B; 2C, 2D; 2E, 2F. There are thus three sensor pairs, and they are disposed consecutively at uniform intervals from each other. In each sensor pair the distance between sensors is L/4 (where L is the wavelength of the magnetic field of the position identifier, see above), and the distance between different sensor pairs (i.e. the distance between e.g. sensors 2B and 2C) is always 3 L/8. Each of three sensor pairs 2A, 2B; 2C, 2D; 2E, 2F is able to form linear position data for the elevator car independently (i.e. without data being received from other sensors). The distance L/4 between sensors in a sensor pair corresponds in radians to $\pi/2$ radian, so that the linear position of the elevator car as indicated by the position identifier can be calculated easily from the measuring signals of the sensor pair measuring the sinusoidal magnetic field of the position identifier, using the trigonometric arcus function, such as the arcus cofunction of the tangent ($\tan^{-1}(x)$).

The stopping floor identifiers 1A, 1B are disposed in such a way that the floor of the elevator car 3 comes to the same height as the floor level 12 when the center point 15 of the reader device 2 and the center point 14 of the stopping floor identifier 1A, 1B are situated facing each other.

FIG. 2*f* illustrates how the measuring signals of the sensors 2A, 2B, 2C, 2D, 2E, 2F in the reader device 2 of FIG. 2*e* are processed for classification of the position identifiers. The signal 13 marked in FIG. 2*f* indicates the measuring signal given by an individual sensor when the positioning device 2 moves past the position identifier of FIG. 2*d* in the direction x of the trajectory of the elevator car. The measuring signals 5 of the different sensors 2A, 2B, 2C, 2D, 2E, 2F are read with the analog-to-digital converter of the microcontroller in the reader device 2. In this context the microcontroller means a computing unit, which comprises at least a microprocessor and also a memory, in which a program to be executed by the microprocessor is recorded. In addition, the computing unit comprises the necessary connection circuits, such as an analog-to-digital converter, a communication circuit, et cetera. The microcontroller registers the measuring signals of the different sensors 2A, 2B, 2C, 2D, 2E, 2F simultaneously. The registration moment of the measuring signals of the different sensors is marked on the signal 13 with transverse lines. Between the measuring signals 5 of the sensors 2A, 2B, 2C, 2D, 2E, 2F is a phase difference owing to the placement of the sensors with respect to each other. Each registered measuring signal is connected in the microcontroller to one of four different signal levels I, II, III, IV. The signal levels I, II, III, IV obtained are compared to a table that is in the memory of the microcontroller and the class of the position identifier is determined on the basis of the comparison. For example, in the situation of FIG. 2*f* the following signal levels are obtained:

| Sensor | 2A | 2B | 2C | 2D | 2E | 2F |
|---|---|---|---|---|---|---|
| Signal level | I | I | IV | II | I | IV |

The number of possible signal levels can also be increased upwards from four, in which case the selectivity of the method increases.

In some embodiments the classification of a position identifier is performed when sufficiently many, most preferably at least two, separate sensors detect a signal level deviating sufficiently from zero. In some embodiments the classification is performed when at least one of the four centermost sensors detects a deviating signal level at the same time as at least one of the sensors detects a signal level that deviates from zero by more than a set minimum value.

By means of the signal levels received from different sensors, the location of the reader device 2 with respect to the position identifier is also roughly known (with an accuracy of approx. L/4). This rough position information is used when selecting the most suitable sensor pair for calculating the linear position. A sensor pair can be selected e.g. in such a way that it is situated closest to the zero point of the sinusoidal magnetic field 5 of a position identifier.

The linear position s of the elevator car is calculated if the class of the position identifier 2 is one of the following:

stopping floor identifier 1A, 1B bottom floor identifier 1C top floor identifier 1G identifier 1D of a reference point between stopping floors, The calculation can be performed simultaneously with two different sensor pairs and the operating condition of the apparatus can be ensured by comparing the results.

If classification of a position identifier 1A, 1B, 1C, 1D, 1E, 1F, 1G does not succeed, i.e. the signal levels I, II, III, IV of the sensors 2A, 2B, 2C, 2D, 2E, 2F do not correspond to any combination allowed by the table, it is deduced that either the position identifier 1A, 1B, 1C, 1D, 1E, 1F, 1G or the reader device 2 is defective or the position identifier has been installed incorrectly. In this case the elevator is driven to the nearest floor and taken out of service. Information about the removal from service is also given to the elevator passengers as well as for, inter alia, the servicing personnel. Fault data can also be sent via a remote connection to the elevator servicing center.

In some embodiments also the speed of the elevator car is calculated from the rate of change of the linear position of the elevator car as the elevator car 3/reader device 2 moves past the position identifier. In this way the precise speed of the elevator car 3 is obtained, from which speed errors in the traction sheave speed measurement have been eliminated, such as the erroneous effect of e.g. elongation of the hoisting ropes and/or slipping of the traction sheave. Consequently, the speed of the elevator car 3 measured from the traction sheave can be corrected on the basis of the speed measurement of the reader device 2.

The polarity of the sensor signal on the edge of an identifier 2 reveals whether it is a stopping floor identifier 1A, 1B or an identifier 1D of the reference point between stopping floors that is involved, i.e. the polarity of the signal also reveals the class of the position identifier 2. This is brought about by installing stopping floor identifiers 1A, 1B the other way around than the identifiers 1D of a reference point, in which case also the magnetic field 5/sensor signal has a different polarity. As was presented above, also a bottom end limit identifier and a top end limit identifier 1E, 1F are distinguished on the basis of the polarity of the magnetic field/signal polarity.

The invention is described above by the aid of a few examples of its embodiment. It is obvious to the person skilled in the art that the invention is not only limited to the embodiments described above, but that many other applications are possible within the scope of the inventive concept defined by the claims.

It is obvious to the person skilled in the art that the classes of the position identifiers 1A, 1B, 1C, 1D, 1E, 1F, 1G can be selected in many different ways. There can also be more, or on the other hand fewer, classes than what was presented in the description above. A person skilled in the art will also appreciate the fact that new different position identifiers/new classes can easily be added retrospectively to an existing elevator by modifying the software of the positioning device 2.

The invention is also well suited to elevators having two or more elevator cars 3 traveling along the same trajectory. The elevator cars can in this case either be connected together or they can move independently of each other.

The invention claimed is:

1. A positioning apparatus for an elevator car, comprising:
a plurality of position identifiers possessing a readable physical property, the plurality of position identifiers being disposed by the side of the trajectory of the elevator car; and
a reader device installed on the elevator car for reading the physical property of the plurality of position identifiers, all of the plurality of position identifiers being disposed on a same side of the elevator car to be readable by the same reader device;
wherein the plurality of position identifiers are classified into two or more optional classes based on intended uses of the plurality of position identifiers, readings of the physical property from position identifiers belong to different optional classes by the same reader device are distinguishable from each other in order to identify respective optional class, and
wherein the same readings of the physical property from position identifiers belonging to at least one of the two or more optional classes by the same reader device additionally indicate a linear position of the elevator car.

2. The positioning apparatus according to claim 1, wherein the readable physical property varies in the position identifier in the direction of the trajectory of the elevator car.

3. The positioning apparatus according to claim 1, wherein the reader device comprises a plurality of sensors that are disposed consecutively and are configured to read the readable physical property.

4. The positioning apparatus according to claim 3, wherein the sensors form sensor pairs, which are disposed consecutively at uniform intervals.

5. The positioning apparatus according to claim 3, wherein the reader device comprises a processor, which is connected to the sensors; and
wherein the reader device comprises a memory, in which a program to be executed by the processor has been recorded, wherein the processor is configured:
to read the measuring data of the sensors,
to classify the position identifier on the basis of the measuring data being read from the sensors and, if the class of the position identifier fulfills a preselected criterion,
to calculate the linear position of the elevator car on the basis of the measuring data being read from the sensors.

6. The positioning apparatus according to claim 1, wherein the class of the position identifier comprises two or more of the following:
top end limit identifier of elevator car trajectory;
bottom end limit identifier of elevator car trajectory;
stopping floor identifier;
top floor identifier;
bottom floor identifier;
servicing space identifier; and
identifier of reference point between stopping floors.

7. An elevator, comprising:
an elevator car adapted to be movable along a trajectory determined by guide rails; and
an electric drive for driving the elevator car,
wherein the elevator comprises the positioning apparatus according to claim 1 for determining the location of the elevator car.

8. A method for determining the position of an elevator car with the positioning apparatus according to claim 1, said method comprising the steps of:
reading a physical property of a position identifier with the reader device; and
classifying the position identifier, on the basis of the physical property read, according to the intended use of the position identifier.

9. The method according to claim 8, further comprising the step of:
if classification of the position identifier does not succeed, removing the elevator from service.

10. The method according to claim 9, further comprising the step of:
determining otherwise the location on the trajectory of the elevator on the basis of the class of the position identifier.

11. The method according claim 8, further comprising the step of:
if the class of the position identifier fulfills a preselected criterion, calculating the linear position of the elevator car on the basis of the readable physical property of the position identifier.

12. The positioning apparatus according to claim 2, wherein the reader device comprises a plurality of sensors that are disposed consecutively and are configured to read the readable physical property.

13. The positioning apparatus according to claim 4, wherein the reader device comprises a processor, which is connected to the sensors; and
wherein the reader device comprises a memory, in which a program to be executed by the processor has been recorded, wherein the processor is configured:
to read the measuring data of the sensors,
to classify the position identifier on the basis of the measuring data being read from the sensors and, if the class of the position identifier fulfills a preselected criterion, to calculate the linear position of the elevator car on the basis of the measuring data being read from the sensors.

14. The positioning apparatus according to claim 2, wherein the class of the position identifier comprises two or more of the following:

top end limit identifier of elevator car trajectory;
bottom end limit identifier of elevator car trajectory;
stopping floor identifier;
top floor identifier;
bottom floor identifier;
servicing space identifier; and
identifier of reference point between stopping floors.

15. The positioning apparatus according to claim 3, wherein the class of the position identifier comprises two or more of the following:

top end limit identifier of elevator car trajectory;
bottom end limit identifier of elevator car trajectory;
stopping floor identifier;
top floor identifier;
bottom floor identifier;
servicing space identifier; and
identifier of reference point between stopping floors.

16. The positioning apparatus according to claim 4, wherein the class of the position identifier comprises two or more of the following:

top end limit identifier of elevator car trajectory;
bottom end limit identifier of elevator car trajectory;
stopping floor identifier;
top floor identifier;
bottom floor identifier;
servicing space identifier; and
identifier of reference point between stopping floors.

17. The positioning apparatus according to claim 5, wherein the class of the position identifier comprises two or more of the following:

top end limit identifier of elevator car trajectory;
bottom end limit identifier of elevator car trajectory;
stopping floor identifier;
top floor identifier;
bottom floor identifier;
servicing space identifier; and
identifier of reference point between stopping floors.

18. An elevator, comprising:

an elevator car adapted to be movable along a trajectory determined by guide rails; and
an electric drive for driving the elevator car,
wherein the elevator comprises the positioning apparatus according to claim 2 for determining the location of the elevator car.

19. A positioning apparatus for an elevator car, comprising:

a plurality of position identifiers possessing a readable physical property, the plurality of position identifiers being disposed by the side of the trajectory of the elevator car; and
a reader device installed on the elevator car for reading the physical property of the position identifiers,
wherein the readable physical property of a position identifier is adapted to classify each position identifier according to the intended use of the position identifier into one of two or more optional classes,
wherein in the position identifiers belonging to at least one of the two or more optional classes, the same physical property is additionally adapted to indicate the linear position of the elevator car, and
wherein the reader device comprises:
a plurality of sensors that are disposed consecutively and are configured to read the readable physical property;
a processor connected to the sensors; and
a memory, in which a program to be executed by the processor has been recorded, wherein the processor is configured:
to read the measuring data of the sensors,
to classify the position identifier on the basis of the measuring data being read from the sensors and, if the class of the position identifier fulfills a preselected criterion, and
to calculate the linear position of the elevator car on the basis of the measuring data being read from the sensors.

20. A method for determining the position of an elevator car with a positioning apparatus, the positioning apparatus comprising a plurality of position identifiers possessing a readable physical property, the plurality of position identifiers being disposed by the side of the trajectory of the elevator car; and a reader device installed on the elevator car for reading the physical property of the position identifiers, wherein the readable physical property of a position identifier is adapted to classify each position identifier according to the intended use of the position identifier into one of two or more optional classes, and wherein in the position identifiers belonging to at least one of the two or more optional classes, the same physical property is additionally adapted to indicate the linear position of the elevator car,
said method comprising the steps of:
reading a physical property of a position identifier with the reader device;
classifying the position identifier, on the basis of the physical property read, according to the intended use of the position identifier; and
if classification of the position identifier does not succeed, removing the elevator from service.

* * * * *